United States Patent [19]

McCarty

[11] 4,429,544

[45] Feb. 7, 1984

[54] REFRIGERANT STORAGE SYSTEM FOR A HEAT PUMP

[75] Inventor: William J. McCarty, Louisville, Ky.

[73] Assignee: General Electric Company, Louisville, Ky.

[21] Appl. No.: 430,904

[22] Filed: Sep. 30, 1982

[51] Int. Cl.[3] ..... F25B 43/02

[52] U.S. Cl. ..... 62/84; 62/324.1; 62/471; 62/503

[58] Field of Search ..... 62/84, 503, 324.1, 324.5, 62/471, 472

[56] References Cited

U.S. PATENT DOCUMENTS

| | | | |
|---|---|---|---|
| 2,121,253 | 6/1938 | McGuffey | 62/115 |
| 2,461,342 | 2/1949 | Obreiter, Jr. | 62/115 |
| 2,770,105 | 11/1956 | Colton | 62/117.7 |
| 3,177,680 | 4/1965 | Rasovich et al. | 62/471 |
| 3,276,215 | 10/1966 | McDonell | 62/84 |
| 3,379,030 | 4/1968 | Garner | 62/471 X |
| 3,381,487 | 5/1968 | Harnish | 62/324.1 X |
| 3,420,071 | 1/1969 | Bottum | 62/471 X |
| 3,636,723 | 1/1972 | Kramer | 62/197 |
| 3,779,035 | 12/1973 | Kramer | 62/503 |
| 4,068,493 | 1/1978 | Micai et al. | 62/194 |
| 4,106,307 | 8/1978 | Matsuda | 62/324 |
| 4,236,381 | 12/1980 | Imral et al. | 62/324 R |

*Primary Examiner*—Lloyd L. King

*Attorney, Agent, or Firm*—Frank P. Giacalone; Radford M. Reams

[57] ABSTRACT

The present invention provides a system for effectively managing the refrigerant charge in a heat pump, and for separating a gaseous refrigerant from liquid refrigerant and oil mixture in a manner that allows oil entrapped with the refrigerant to transfer to the compressor, and to insure that only refrigerant in gaseous phase is allowed to enter the compressor through the suction line.

8 Claims, 2 Drawing Figures

REFRIGERANT STORAGE SYSTEM FOR A HEAT PUMP

BACKGROUND OF THE INVENTION

A compressor of a refrigeration system is designed primarily for gas compression. However, under some operating circumstances, liquid refrigerant may pass from the evaporator of the system through the suction line and into the inlet of the compressor. If this liquid floodover is substantial, the compressor parts may be damaged due to the incompressibility of the liquid refrigerant with resultant high bearing loads. In addition, the liquid refrigerant may dilute the lubricant contained in the compressor casing with resultant deterioration of lubricity.

In order to solve this problem, it is usual practice to provide a suction accumulator between the evaporator and the compressor having as its primary function the passage of gaseous refrigerant to the compressor and trapping of liquid refrigerant when this liquid is present in excessive amounts. The liquid refrigerant retained by the accumulator is metered to the compressor at a controlled rate such that damage to the compressor and its associated components is prevented.

In other prior art refrigerant accumulators employed in separating liquid refrigerant from gaseous refrigerant, metering holes are provided in the lower portion of the accumulator container wherein oil settling in the lower portion may be returned to the compressor with the gaseous refrigerant. This arrangement, however, allows liquid refrigerant in mixture with the oil to also return to the compressor.

The present invention relates to a heat pump and more particularly to a heat pump comprising a reversible refrigerant circuit including means for controlling the effective charge of refrigerant in the circuit. More particularly, the present invention provides means for separating gaseous refrigerant from a liquid refrigerant and oil mixture and for preventing passage of damaging amounts of liquid refrigerant to the compressor while allowing gaseous refrigerant entrapped with liquid refrigerant to be separated therefrom and returned to the compressor.

SUMMARY OF THE INVENTION

An object of the present invention is to provide a means in a heat pump refrigeration system that effectively controls the charge of refrigerant in both heating and cooling modes of operation while insuring that liquid refrigerant is not returned to the compressor while allowing oil to be returned to the compressor.

In accordance with the present embodiment, there is employed a reversible refrigeration system including a hermetically sealed casing containing a high pressure refrigerant gas. Arranged in the casing in the system is a compressor and a compressor motor. Connected to the casing is a suction line for delivering low pressure refrigerant gas to the casing and a high pressure line for discharging high pressure refrigerant gas from said casing. The system includes the customary condenser and evaporator connected in refrigerant flow relationship with the high pressure and suction lines, respectively, and having connected therebetween a flow restricting means. The refrigeration system employed in carrying out the present invention further includes a superheat removal coil having its outlet connected to the casing thereby to cool the high pressure refrigerant gas from the compressor and to discharge the partially cooled gas back into the casing to cool the compressor motor. The means for controlling the effective charge of refrigerant in the system includes a refrigerant accumulator connected to the suction line for collecting refrigerant oil mixture in the suction line. The accumulator includes a casing having a generally cylindrical side wall and top and bottom walls. A portion of the suction line from the evaporator terminates in the upper portion of the accumulator, while a portion of the suction line leading to the compressor extends through the bottom wall of the accumulator and terminates at an inlet end positioned in the upper portion of the accumulator for transferring refrigerant in gaseous state to the compressor. A reservoir is positioned in heat exchange relationship with the superheat removal coil and is connected to the accumulator by a first capillary tube having one end positioned in the lower end of the accumulator and its other end positioned in the lower end of the reservoir for transferring oil and liquid refrigerant, when present, from the accumulator to the reservoir.

The reservoir is connected to the suction line downstream of the accumulator by a second capillary tube having one end positioned in the lower portion of the reservoir and its other end positioned in the suction line intermediate the refrigerant reservoir and the compressor for transferring oil when present in the lower portion of the reservoir to the compressor through the suction line. Refrigerant in gaseous phase is transferred to the accumulator through a gas return conduit connecting the upper portions of the accumulator and the reservoir for transferring the gaseous refrigerant to the compressor through the suction line.

DESCRIPTION OF THE PREFERRED EMBODIMENT

Figure 1:
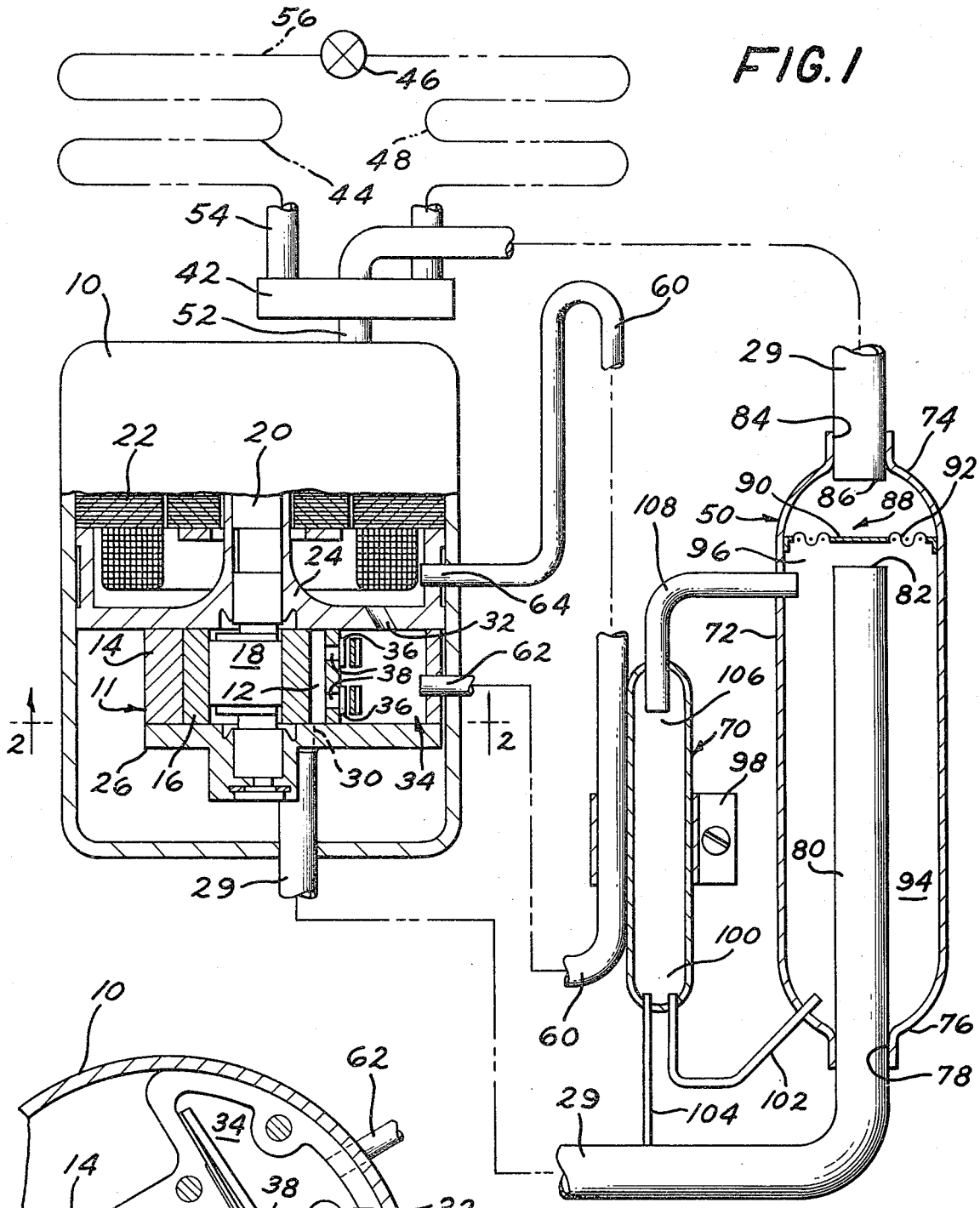
FIG. 1 is a schematic of a reversible heat pump system embodying the present invention.
Figure 2:
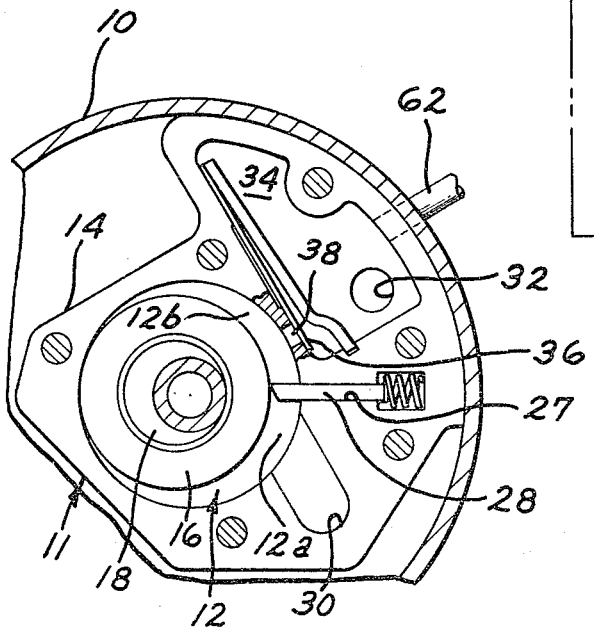
FIG. 2 is a sectional view of the compressor taken along line 2—2 of FIG. 1.

Referring to the drawing, there is shown a hermetic compressor including a casing 10 in which there is disposed a refrigerant compressor unit 11 having an annular compression chamber 12 defined within a cylinder 14. Disposed for rotation within the compression chamber 12 is a rotor 16, which is driven by an eccentric 18 formed as an integral part of a drive shaft 20 which extends downwardly from the motor 22. A supporting main frame 24 defines the upper end wall of the chamber 12, while a lower plate 26 defines the lower end wall of the chamber 12. As seen in FIG. 2, within the cylinder 12 there is provided a radial slot 27 having slidably disposed therein a blade and vane 28 which is biased into engagement with the outer periphery of the rotor 16, thereby dividing the chamber 12 into low and high pressure sides **12*a* and 12*b***, respectively.

Suction gas is drawn or delivered into the low pressure side **12*a* of the chamber 12 from the suction line 29 and more specifically through a suction port area 30. Suction gas delivered into low pressure side 12*a* is compressed between the peripheral surface of rotor 16, the side of the angular chamber 12, and the high pressure side of the vane 28 during rotation of the rotor 16 around chamber 12. Means, including a pair of discharge ports 38 and a discharge chamber 34**, are provided for discharging the high pressure gas from high pressure side 12*b* of chamber 12 into the casing 10. Mounted within the discharge chamber 34 is a suitable valve 36 for assuring proper compression of the gas issuing through the discharge port 38 and preventing reverse flow of gas back into the chamber 12. High pressure gas from discharge chamber 34 flows into the hermetic casing 10 through passage 32 in the frame 22.

A compressor of this type is adapted to be connected into a refrigeration system which in the present invention is a reversible heat pump including a reversing valve 42, an indoor heat exchanger coil 44, a flow restrictor 46, an outdoor heat exchanger coil 48, and a suction accumulator 50. During operation of the system as a heat pump in the heating cycle, the reversing valve 42 directs the flow of high pressure refrigerant gas from the discharge line 52 of the compressor through a line 54 into the indoor heat exchanger 44, which then functions as the system condenser to warm the air to be conditioned and to condense the refrigerant gas into liquid form. The refrigerant is partially or completely condensed by the air circulated therethrough by a fan (not shown). The refrigerant then flows through line 56 including expansion device 46 to the outdoor heat exchanger 48, now functioning as the system evaporator, and then back through valve 42 suction line 29 and into the compressor.

During operation of the system in the cooling cycle, high pressure refrigerant gas is directed by the reversing valve 42 into the outdoor heat exchanger 48 which now functions as the condenser. The refrigerant then flows through line 56, including expansion device 46 and indoor heat exchanger 44 which now functions as the evaporator to cool the area to be conditioned. Refrigerant then is directed by valve 42 to suction line 29 and back to the compressor.

In order to cool the high pressure gas prior to passing this gas into the casing, there is provided a superheat removal coil 60 having one end 62 connecting with the discharge chamber 34 and the other end 64 leading into the casing 10. The coil 60 is arranged outside of the casing 10 and is normally exposed to outdoor air which removes heat from the coil. The outlet 64 of the superheat coil 60 communicates with the inside of the casing and discharges the partially cooled gas into the casing for cooling the motor 22. After cooling the motor, the high pressure gas discharges from the casing through high pressure line 52 back to the reversing valve where it is directed into the remaining portion of the refrigeration system. Gas flowing through the superheat removal coil generally remains in gaseous form, but if a small amount of refrigerant liquifies in the coil, it is immediately carried out of the coil by the gas as it flows into the casing and, under normal operating conditions, the liquid is flashed into gaseous form when carried into contact with the relatively warm motor surface.

By the present invention, a means for managing the refrigerant charge in the refrigeration system is provided including the accumulator 50 and a reservoir or container 70. The suction accumulator 50 is connected into the system suction line through the valve 42 so as to be between the heat exchanger functioning as the evaporator and the suction port 30 of the compressor. The primary purpose of the present accumulator is to allow separation of gaseous refrigerant from any liquid refrigerant flowing from the evaporator into the accumulator, and to meter gaseous refrigerant and any oil present therein to the compressor. The accumulator comprises a vertically extending cylindrical casing 72 tapering at its upper and lower ends to form a top wall 74 and a bottom wall 76. Specifically, the bottom wall 76 is generally funnel-shaped and includes an opening 78 at the lower end thereof for receiving the standpipe 80 of the suction line 29. The open upper end 82 of standpipe 80 is positioned in the upper portion of casing 72. The upper end 74 of the casing is generally hemispherical in shape and includes an opening 84 at the upper end thereof for receiving an open end refrigerant inlet portion 86 of the suction conduit 29 leading from the evaporator. The accumulator 50 also includes baffle 88 which has an impervious central portion 90 positioned over the open end 82 of standpipe 80 to prevent refrigerant entering the casing 72 through inlet portion 86 from being transmitted directly into the open end 82 of standpipe 80. The central portion 90 is supported in the casing 72 by a substantially circumferentially disposed screen or open portion 92 that permits refrigerant from inlet portion 86 to enter the casing 72 and collect in the lower portion 94 of the accumulator 50. The feed of liquid refrigerant from the lower portion 94 of the accumulator 50 to the lower portion 100 of the reservoir 70 is by gravity. Accordingly, the lower portion 100 of the inlet of the tube 102 should be at the same level or lower than the inlet of the tube 102 positioned in the lower portion 94 of the accumulator.

During the operation of the refrigeration system, refrigerant plus any entrained oil or lubricant collects in the storage volume provided by the lower portion 94 of the accumulator 50. The position of inlet 82 in the upper portion 96 of the accumulator 50 assures the flow of only gaseous refrigerant into the open end 82 of standpipe 80 of suction line 29. The positioning of inlet 82 in the upper portion 96 of the accumulator causes liquid refrigerant and oil to collect in the lower portion 94 and provide effective means for separating liquid refrigerant from gaseous refrigerant and for preventing passage of damaging amounts of liquid refrigerant to the compressor under all normal and abnormal operating conditions.

By the present invention, means are also provided for returning the liquid refrigerant and oil collected in the lower portion 94 of the accumulator 50 to the operating system. These means include the reservoir 70 which is maintained in heat exchange relationship with the relatively warm superheat coil 60 by a strap or bracket 98. The lower portion 100 of reservoir 70 is connected by a conduit 102 to the lower portion 94 of accumulator 50. The lower portion 100 of reservoir 70 is also connected to the suction line 29 intermediate the accumulator 50 and suction port 30 by a metering conduit 104. The upper portion 106 of reservoir 70 is connected to the upper portion 96 of accumulator 50 by a conduit 108.

In operation, as mentioned above, a mixture of liquid refrigerant and oil is collected in lower portion 94 of the accumulator 50. This mixture of liquid refrigerant and oil is introduced into the lower portion 100 of reservoir 70 through conduit 102. Due to the heat exchange relationship between reservoir 70 and relatively warm superheat coil 60, the liquid refrigerant is instantly boiled out into gaseous phase as it is metered into the reservoir 70 and rises to upper portion 106. This refrigerant in gaseous phase flows out of portion 106 through conduit 108 and is then introduced into the upper portion 96 of the accumulator 50. Gaseous refrigerant entering portion 96 mixes with gaseous refrigerant present in the accumulator and enters the open end 82 of standpipe 80 of suction line 29 to be returned to the suction port 30 and the refrigeration system. The oil introduced into the lower portion 100 of reservoir 70 through conduit 102 with the liquid refrigerant flows through conduit 104 and is metered into the suction line 29 where it is returned to the compressor.

To insure that liquid refrigerant instantly boils out in gaseous phase as it is introduced into the reservoir 70, it is necessary that the reservoir be maintained at a temperature that will in fact cause this change in fluid phase. In the present embodiment it was found that the superheat coil 60 provided sufficient heat to meet this requirement. However, it should be noted that the reservoir 70 may be heated sufficiently to cause refrigerant to boil out into gaseous phase by other means which may include a resistance heater or other relatively warm refrigerant components such as the compressor or discharge line.

It should be apparent that the conduits 102 and 104 are sized so that the flow of liquid refrigerant and oil into reservoir 70 and the oil to the suction line 29 are sized to provide proper metering under all conditions the system may be subjected to. In the present invention, tubes having an inside diameter of 0.031 inches were employed to achieve desirable storage and metering.

In summary, a system is herein provided which, under all normal and abnormal operating conditions, allows an effective refrigerant charge management in a heat pump by employing a simple and low cost accumulator and reservoir arrangement.

The foregoing is a description of the preferred embodiment of the apparatus and method of the invention, and it should be understood that variations may be made thereto without departing from the true spirit and scope of the invention as defined in the appended claims.

What is claimed is:

1. The method of managing the refrigerant charge in a refrigeration system by storing liquid refrigerant and introducing it in gaseous form back into the system a compressor comprising:

accumulating a mixture of liquid refrigerant and oil in an accumulator positioned in the suction line of the system;

separating gaseous refrigerant from liquid refrigerant in said accumulator and introducing the gaseous refrigerant into the system compressor;

introducing the remaining mixture of liquid refrigerant and oil in said accumulator to a reservoir;

heating said reservoir to boil out refrigerant in gaseous form; and introducing the gaseous refrigerant to the accumulator for introduction into the system compressor; and introducing the oil in the reservoir to the compressor.

2. The method recited in claim 1 further including locating said reservoir in heat exchange relationship with a relatively warm component of said refrigeration system.

3. A charge management arrangement system for a refrigeration system including a compressor comprising:

a refrigerant suction accumulator for collecting a liquid refrigerant oil mixture including a casing having a generally cylindrical side wall and top and bottom walls;

an inlet suction line extending through said upper wall and terminating in the upper portion of said cylinder, an outlet portion of said suction line extending through said bottom wall and terminating at an inlet end in the upper portion of said reservoir for transferring refrigerant in gaseous state;

a reservoir adapted to be heated to a temperature sufficient to cause refrigerant to change to a gaseous phase;

a first capillary tube having one end positioned in the lower end of said accumulator and its other end positioned in the lower end of said container for transferring oil and liquid refrigerant when present from said accumulator to said reservoir;

a second capillary tube having one end positioned in the lower portion of said reservoir and its other end positioned in said suction line intermediate said refrigerant container and said compressor for transferring oil when present in the lower portion of said reservoir to said compressor through said suction line;

a gas return conduit connecting the upper portions of said accumulator and said reservoir for transferring gaseous refrigerant when present in the upper portion of said reservoir to the upper portion of said accumulator for transferring gaseous refrigerant to said compressor through said suction line.

4. The charge management arrangement recited in claim 3 wherein said reservoir is positioned in heat exchange relationship with a relatively warm refrigerator system component.

5. The charge management arrangement recited in claim 4 wherein said relatively warm refrigerant component is a superheat removal coil connected for cooling a portion of the relatively warm high pressure refrigerant gas prior to its being discharged by the system compressor.

6. A refrigeration system comprising:

a hermetically sealed casing for containing a high pressure refrigerant gas;

a compressor and a compressor motor mounted in said casing;

a suction line for delivering low pressure refrigerant gas to said casing;

a high pressure line for discharging high pressure refrigerant gas from said casing;

a condenser and evaporator connected in refrigerant flow relationship with said high pressure and suction line, respectively, having connected therebetween a flow restricting means;

a refrigerant accumulator connected to said suction line for collecting a liquid refrigerant oil mixture in said suction line including a casing having a generally cylindrical side wall and top and bottom walls, a portion of said suction line from said evaporator terminating in the upper portion of said accumulator, a portion of said suction line leading to said compressor extending through said bottom wall and terminating at an inlet end in the upper portion of said accumulator for transferring refrigerant in gaseous state to said compressor;

a reservoir positioned in heat exchange relationship with a relatively warm refrigeration system component;

a first capillary tube having one end positioned in the lower end of said accumulator and its other end positioned in the lower end of said container for transferring oil and liquid refrigerant when present from said accumulator to said reservoir;

a second capillary tube having one end positioned in the lower portion of said reservoir and its other end positioned in said suction line intermediate said refrigerant container and said compressor for transferring oil when present in the lower portion of said reservoir to said compressor through said suction line;

a gas return conduit connecting the upper portions of said accumulator and said reservoir for transferring gaseous refrigerant when present in the upper portion of said reservoir to the upper portion of said accumulator for transferring gaseous refrigerant to said compressor through said suction line.

7. The refrigeration system recited in claim 6 wherein a superheat removal coil having its outlet connected with said casing thereby to cool the high pressure refrigerant gas from said compressor and to discharge said partially cooled gas into said casing to cool said compressor motor; and said reservoir is positioned in heat exchange relationship with said superheat removal coil for causing refrigerant in said reservoir to boil out in gaseous phase.

8. A reversible refrigeration system comprising:

a hermetically sealed casing for containing a high pressure refrigerant gas;

a compressor and a compressor motor mounted in said casing;

a reversing valve;

a suction line for delivering low pressure refrigerant gas from said reversing valve to said casing;

a high pressure line for delivering high pressure refrigerant gas from said casing to said reversing valve;

a pair of heat exchangers connected in refrigerant flow relationship with said reversing valve having connected therebetween a flow restricting means;

a superheat removal coil having its outlet connected with said casing thereby to cool the relatively warm, high pressure refrigerant gas from said compressor and to discharge, said partially cooled gas into said casing to cool said compressor motor;

a refrigerant accumulator connected to said suction line for collecting a liquid refrigerant oil mixture in said suction line including a casing having a generally cylindrical side wall and top and bottom walls, a portion of said suction line from said valve terminating in the upper portion of said accumulator, a portion of said suction line leading to said compressor extending through said bottom wall and terminating at an inlet end in the upper portion of said accumulator for transferring refrigerant in gaseous state to said compressor;

a reservoir positioned in heat exchange relationship with said relatively warm superheat removal coil to thereby raise the temperature of said reservoir;

a first capillary tube having one end positioned in the lower end of said accumulator and its other end positioned in the lower end of said reservoir for transferring oil and liquid refrigerant when present from said accumulator to said warmer reservoir wherein gaseous refrigerant is boiled out of said liquid refrigerant;

a second capillary tube having one end positioned in the lower portion of said reservoir and its other end positioned in said suction line intermediate said refrigerant container and said compressor for transferring oil when present in the lower portion of said reservoir to said compressor through said suction line;

a gas return conduit connecting the upper portions of said accumulator and said reservoir for transferring gaseous refrigerant when present in the upper portion of said reservoir to the upper portion of said accumulator for transferring gaseous refrigerant to said compressor through said suction line.

* * * * *